US007053320B2

(12) United States Patent
Kodo et al.

(10) Patent No.: US 7,053,320 B2
(45) Date of Patent: May 30, 2006

(54) SWITCH DEVICE

(75) Inventors: Eiji Kodo, Fukui (JP); Tatsuya Tsuda, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/826,408

(22) Filed: Apr. 19, 2004

(65) Prior Publication Data

US 2005/0006210 A1 Jan. 13, 2005

(30) Foreign Application Priority Data

Jul. 7, 2003 (JP) ..... 2003-192655

(51) Int. Cl.
*H01H 21/54* (2006.01)

(52) U.S. Cl. ..... 200/17 R; 200/11 R; 200/11 TW

(58) Field of Classification Search ..... 200/6 A, 200/11 R, 11 TW, 18, 4, 14, 564, 568, 573, 200/336, 19.2, 19.07, 19.13, 17
See application file for complete search history.

(56) References Cited

U.S. PATENT DOCUMENTS 4,405,842 A * 9/1983 Wermelinger ..... 200/17 R
4,926,011 A * 5/1990 Saito ..... 200/6 A
5,380,965 A * 1/1995 Moller ..... 200/11 R
5,901,835 A * 5/1999 Hung ..... 200/316
5,933,065 A * 8/1999 Duchemin ..... 335/190
5,967,304 A * 10/1999 MacKay et al. ..... 200/565
6,072,139 A 6/2000 Nakase et al.
6,127,636 A * 10/2000 Parvulescu et al. ..... 200/11 R
6,404,354 B1 * 6/2002 Decker et al. ..... 341/35
6,670,567 B1 12/2003 Koseki et al.

FOREIGN PATENT DOCUMENTS

| | | |
|---|---|---|
| JP | 10-021788 | 1/1998 |
| JP | 11-260201 | 9/1999 |
| JP | 2001-236861 | 8/2001 |
| JP | 2001-250453 | 9/2001 |

* cited by examiner

*Primary Examiner*—K. Lee
(74) *Attorney, Agent, or Firm*—Wenderoth, Lind & Ponack, L.L.P.

(57) ABSTRACT

A switch device is configured by engaging a plurality of switches in a cam section of an operating member in a manner such that a detecting section can detect positions of operation of the operating member based on electric ON/OFF states of the switches. With this arrangement, it is possible to detect the positions of operation of the operating member by only detecting the electric ON/OFF states of the switches wherever the position of operation the operating member may be. Consequently, a switch device that is simple in construction and capable of reliably detecting positions of operation of the operating member can be provided.

14 Claims, 7 Drawing Sheets

SWITCH DEVICE

TECHNICAL FIELD

The present invention relates to a switch device to be used in control sections of various electronic equipment.

BACKGROUND ART

In association with the recent trend toward diversification and enhanced functionality of various electronic equipment such as video, audio and air-conditioning equipment, there are an increasing number of devices in which a desired function is selected among a variety of functions by turning a switch device to a particular position among several positions. A description of a conventional switch device of this type will be given referring to FIG. 8 and FIG. 9.

FIG. 8 is a perspective view of a conventional switch device. A plurality of wiring patterns (not shown) are formed on the top and rear surfaces of wiring board 1 (hereinafter "board"). Operating member 2 is rotatably mounted on the top surface of board 1. Roughly disc-shaped knob 2A is formed on the top surface of operating member 2 while two or more protruding portions 3A, 3B, 3C, etc., are formed on the outer periphery of the lower part roughly in the form of a gear.

Also, switch 10 has lever 4 and lever 4 protrudes in a swingable manner from case 5 made of an insulating resin. Swinging motion of lever 4 around fulcrum 4A causes a movable contact (not shown) to move into contact with fixed contacts (not shown). Terminals 6A, 6B, 6C are provided for outputting electrical signals from the switch 10.

Switch 10 is laid on the top surface of board 1 in a manner such that lever 4 engages protruding portions 3A, 3B, 3C, etc., of operating member 2. Also, terminals 6A, 6B, 6C are soldered to predetermined wiring patterns and connected with detecting section 7 composed of electronic components including a microcomputer.

The switch device configured as described above is mounted in electronic equipment in a manner such that knob 2A of operating member 2 is disposed in the control section on the front surface of the equipment. And the wiring patterns on board 1 are electrically connected to the electronic circuits of the equipment through a connector and the like.

Operation of the switch device having the above configuration will be described with reference to fragmentary plan views in FIG. 9A to FIG. 9C. In order to switch between functions of the equipment, knob 2A is rotated clockwise by 45°, for example, from the position shown in FIG. 9A. By this rotating operation, operating member 2 is rotated as shown in FIG. 9B and protruding portion 3B pushes lever 4 of switch 10 and lever 4 swings from the neutral position to the left around fulcrum 4A. With this operation, movable contacts housed inside case 5 are moved into or out of contact with fixed contacts, and terminals 6A, 6B, for example, output the electric signals to detecting section 7 and the function of the equipment is switched.

When knob 2A is further rotated clockwise by 45° after protruding portion 3B is detached from lever 4 and lever 4 temporarily returns to the neutral position, lever 4 is pushed by protruding portion 3C to swing again to the left, and the second electric signal is output from terminals 6A, 6B to detecting section 7. Detecting section 7 detects the electric signal from terminals 6A, 6B. Detecting section 7 detects the position of operation of operating member 2 in a manner such that, when an electric signal is output once, detecting section 7 detects that operating member 2 is rotated clockwise by 45°, and when electric signals are output twice, detecting section 7 detects that the operating member 2 is rotated by 90°, and stores the information.

Conversely, when knob 2A is rotated counterclockwise as shown in FIG. 9C from the position in FIG. 9A, operating member 2 is rotated counterclockwise and protruding portion 3A pushes lever 4. Since lever 4 swings to the right as a result of this operation, terminals 6A, 6C output an electric signal to detecting section 7. Detecting section 7 detects the electric signal and determines that operating member 2 is rotated counterclockwise by 45° and stores the information.

That is, depending on whether the pair of terminals 6A, 6B or the pair of terminals 6A, 6C of switch 10 output the signal, detecting section 7 determines the direction of rotation of operating member 2. Also, detecting section 7 determines the angle of rotation based on how many times electric signals are output and stores the information. This type of switch device is disclosed in Japanese Patent Unexamined Publication No. 2001-236861, for example.

In the above-described conventional switch, however, detecting section 7 has always to store the information on how many times knob 2A of operating member 2 is rotated in which direction. Also, when knob 2A is rotated under a state in which the power of the equipment is not on and no power is supplied to detecting section 7, a problem occurs. That is, when the power is turned on next, the position of operation as stored in detecting section 7 does not agree with the actual position of operation of knob 2A. As a result, it becomes necessary to provide some sort of detecting means or to provide correcting means in the electronic circuit, thereby increasing the complexity and cost of the switch device.

SUMMARY OF THE INVENTION

A switch device of the present invention includes an operating member having a cam section which is provided with a protruding portion, a plurality of switches, and a detecting section. The switches engage the cam section and the detecting section detects the position of operation of the operating member based on the electric ON/OFF states of the switches.

DETAILED DESCRIPTION OF THE INVENTION

Figure 1:
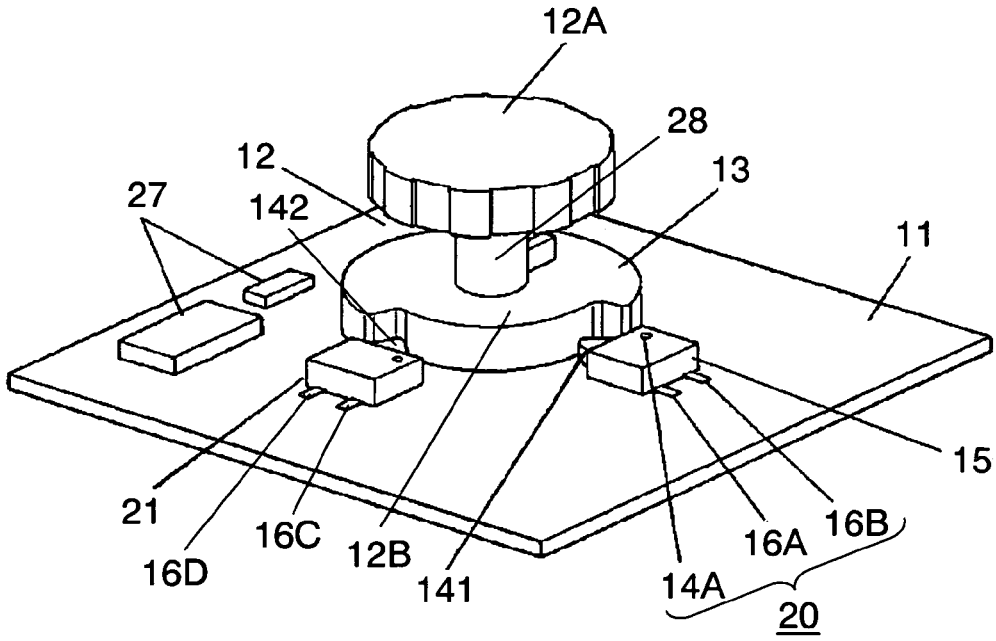
FIG. 1 is a perspective view of a switch device in an exemplary embodiment of the present invention.

FIG. 1 is a perspective view of a switch device in an exemplary embodiment of the present invention. FIG. 2A to FIG. 2D are fragmentary plan views of the switch device of FIG. 1. A plurality of wiring patterns (not shown) are formed on the top and rear surfaces of wiring board 11 (hereinafter "board"). Operating member 12 is mounted on the top surface of board 11 in a rotatable manner. Roughly disc-shaped knob (or user-operable member) 12A is formed on the upper part of operating member 12, and cam section 12B having protruding portion 13 on the outer periphery is formed on the lower part of operating member 12, Coupling section 28 is interposed between knob 12A and can section 12B. Protruding portion 13 is provided over a predetermined angle with respect to the axis of rotation of operating member 12. Switch 20 has lever 141 and lever 141 projects in a swingable manner out of case 15 made of an insulating resin. Swinging motion of lever 141 around fulcrum 14A causes a movable contact (not shown) housed inside case 15 to be moved into or out of contact with fixed contacts (not shown). Switch 20 outputs a resultant electric signal via terminals 16A, 16B. Switch 20 is laid on the top surface of board 11 in a manner such that lever 141 engages cam section 12B of operating member 12. Also, terminals 16A, 16B are soldered to predetermined wiring patterns on board 11 and connected to detecting section 27 composed of electronic components including a microcomputer. Switch 21 is configured in a manner similar to switch 20 and has lever 142 and terminals 16C, 16D. Switch 20 and switch 21 are disposed 90° apart from each other with respect to the axis of rotation of operating member 12. The structure of each of the switches 20, 21 is disclosed in Japanese Patent Unexamined Publication No. H10-21788, for example.

The switch device configured as described above is mounted on electronic equipment with knob 12A of operating member 12 disposed in a control section of the front panel of the electronic equipment, and the wiring patterns on board 11 are electrically connected to electronic circuitry of the electronic equipment via a connector and the like. In mounting the switch device, as coupling section 28 is provided, it suffices to make a small hole in the electronic equipment.

Next, the operation of the switch device as configured above will be described referring to FIG. 2A to FIG. 2D.

Figure 2A:
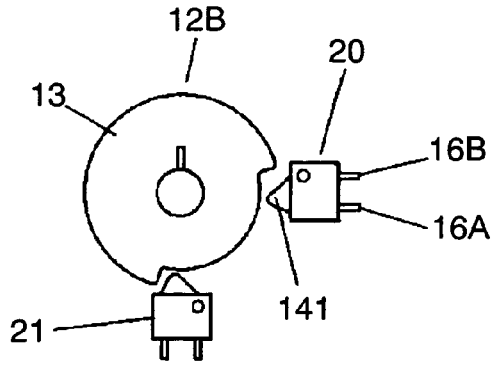
FIG. 2A to FIG. 2D are fragmentary plan views of the switch device of FIG. 1.

FIG. 2A illustrates a state in which protruding portion 13 of operating member 12 is neither engaging lever 141 of switch 20 nor lever 142 of switch 21. As switches 20, 21 are in the OFF state, terminals 16A, 16B, 16C, 16D do not output electric signal to detecting section 27.

Figure 2B:
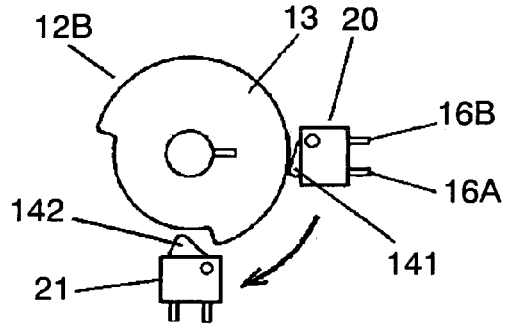

In order to switch over equipment function from this state, knob 12A is rotated clockwise by 90° as shown in FIG. 2B. With this operation, cam section 12B is rotated, protruding portion 13 pushes lever 141 of switch 20, the movable contact housed inside case 15 is brought into contact with fixed contacts and switch 20 is turned on. Terminals 16A, 16B output an electric signal of this state to detecting section 27 and the function of the equipment is switched. In this state, as switch 21 is not engaging protruding portion 13, switch 21 is not outputting an electric signal to detecting section 27.

Figure 2C:
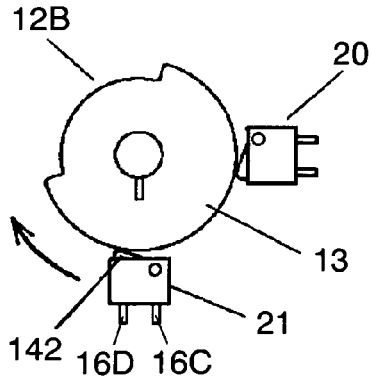

Subsequently, as shown in FIG. 2C, knob 12A is further rotated clockwise by 90°. With this operation, cam section 12B is rotated, protruding portion 13 pushes lever 141 of switch 21 and switch 21 is also turned on. As a result, each of switches 20, 21 outputs an electric signal to detecting section 27.

Figure 2D:
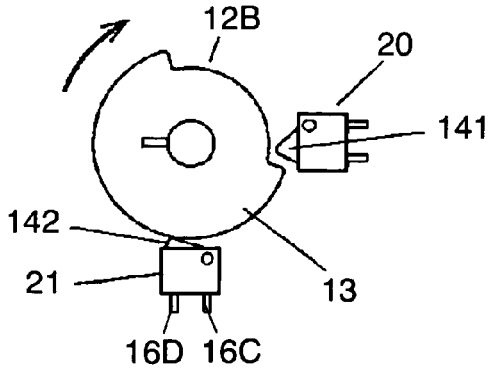

Additionally, knob 12A is further rotated clockwise by 90°, namely, to a position of 270° from the state of FIG. 2A. As shown in FIG. 2D, while lever 142 remains pushed by protruding portion 13, lever 141 becomes free from protruding portion 13. Switch 20 is thus in the OFF state and switch 21 is in the ON state. Electric signals of the states are output to detecting section 27.

In summary, in the state of FIG. 2A, both switches are in the OFF state while in the state of FIG. 2B in which the operating member is rotated by 90°, only switch 20 is in the ON state. In the state of 180° rotation of FIG. 2C, both switches are in the ON state and, in the state of 270° rotation of FIG. 2D, only switch 21 is in the ON state. In this way, switches 20, 21 are made to engage cam section 12B of operating member 12 and detecting section 27 detects the position of operation of operating member 12 depending on the electric ON or OFF state of these two switches.

As the electric ON or OFF state of switches 20, 21 depends on the position of operation of operating member 12 in this way, there is no need for detecting section 27 to store the information on how far operating member 12 is rotated in which direction. Also, even when operating member 12 is rotated in a state in which the power of the equipment is switched OFF and no power is being supplied to detecting section 27, no trouble occurs. That is, when the power is switched on next time, detecting section 27 immediately detects the position of rotation of operating member 12 from the electric ON or OFF state of switches 20, 21.

As is described above, in this configuration, switches 20, 21 engage cam section 12B of operating member 12 and detecting section 27 detects the position of operation of operating member 12 based on the electric the ON or OFF state of switches 20, 21. By configuring the switch device in this way, position of operation of operating member 12 can be detected by only detecting electric ON or OFF state of switches 20, 21 wherever the position of operation of operating member 12 may be. Consequently, a switch device is obtainable that is simple in structure and is capable of reliably detecting the position of operation of operating member 12.

In the above description, switches 20, 21 are disposed to the right and in the lower part of operating member 12 at an angle of 90° from each other relative to the axis of rotation of operating member 12. A description is also made of a configuration in which operating member 12 can be rotated to four positions in increments of 90°. In addition to this, a switch device may also be configured by changing the locations of the switches, the location and angle of providing protruding portion 13, or disposing many switches in order that various positions of rotation of operating member 12 can be detected.

Next, another exemplary embodiment of the present invention will be described. Structural elements that are the same as those in the above-described configuration are given the same reference numerals and detailed description is omitted.

Figure 3:
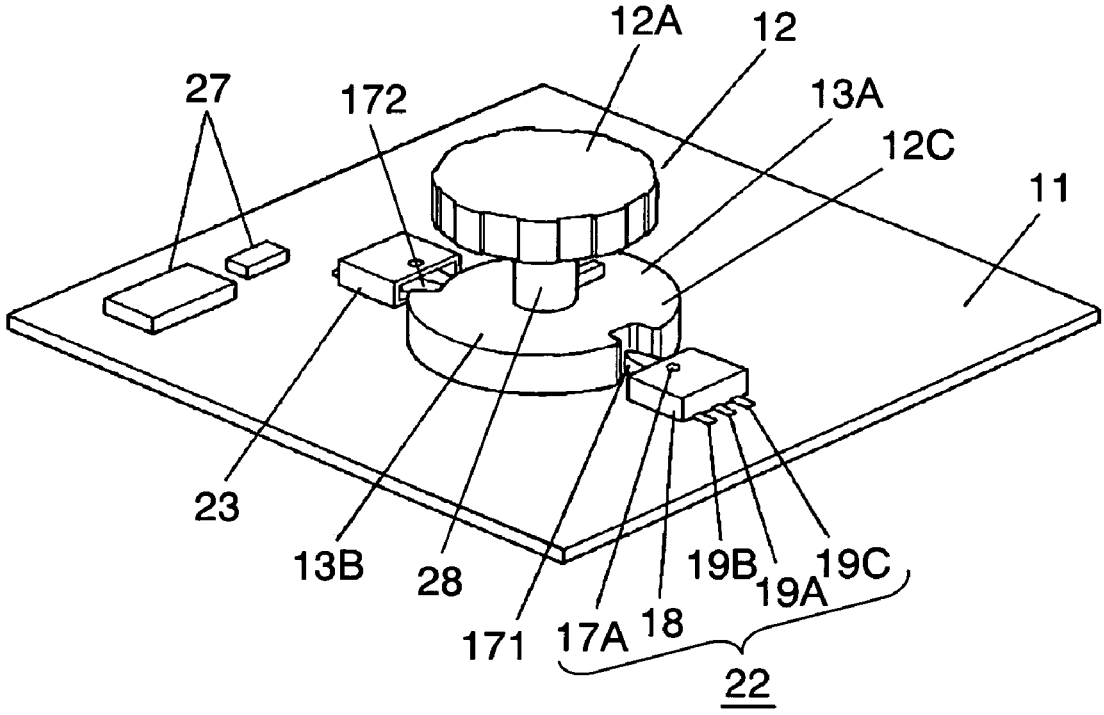
FIG. 3 is a perspective view of another switch device in the exemplary embodiment of the present invention.

FIG. 3 is a perspective view of another switch device in the exemplary embodiment of the present invention. FIG. 4A to FIG. 4E are fragmentary plan views of the switch device of FIG. 3. Cam section 12C having a plurality of protruding portions 13A, 13B on the outer periphery is formed under operating member 12. Protruding portions 13A, 13B are provided over respective predetermined angles with respect to the axis of rotation of operating member 12.

Switch 22 has lever 171, and lever 171 projects in a swingable manner out of case 18 made of an insulating resin. By a swinging motion of lever 171 around fulcrum 17A, a movable contact (not shown) housed inside case 18 is brought into contact with or detached from a plurality of fixed contacts (not shown). Switch 22 outputs respective electric signals via terminals 19A, 19B, 19C.

Switch 22 is laid on the top surface of board 11 in a manner such that lever 17 engages cam section 12C of operating member 12. Terminals 19A, 19B, 19C are soldered to predetermined wiring patterns on board 11 and connected to detecting section 27. Switch 23 is configured in the same manner as switch 22 and has lever 172 and terminals 19D, 19E, 19F. Switch 22 and switch 23 are disposed at 180° from each other relative to the axis of rotation of operating member 12. The configuration of switches 22, 23 is disclosed in Japanese Patent Unexamined Publication No. H11-260201, for example.

The switch device configured as described above is mounted on electronic equipment with knob 12A of operating member 12 disposed in a control section on the front panel of the electronic equipment, and the wiring patterns on board 11 are electrically connected to electronic circuitry of the electronic equipment via a connector and the like.

Next, operation of the switch device having the above configuration will be described referring to FIG. 4A to FIG. 4E.

Figure 4A:
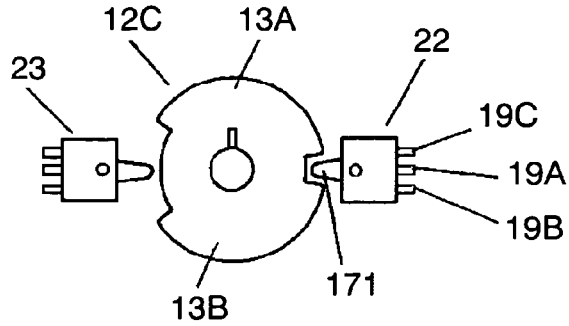
FIG. 4A to FIG. 4E are fragmentary plan views of the switch device of FIG. 3.

FIG. 4A illustrates a state in which protruding portions 13A, 13B of operating member 12 are engaging neither lever 171 of switch 22 nor lever 172 of switch 23. As switches 22, 23 are in the OFF state, terminals 19A, 19B, 19C, 19E, 19F are not outputting an electric signal to detecting section 27.

Figure 4B:
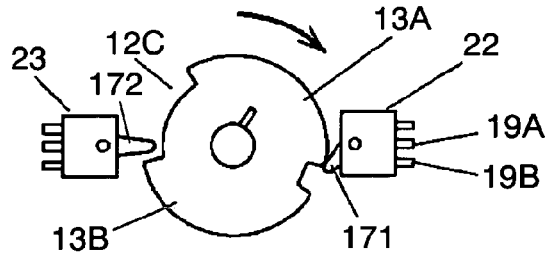

In order to switch over function of the electronic equipment from this state, knob 12A is rotated clockwise by 30° as shown in FIG. 4B. With this operation, operating member 12 is rotated, protruding portion 13A pushes lever 171, lever 171 swings downwardly from the neutral position, and terminals 19A, 19B of switch 22 become mutually conducting, namely in the ON state. An electric signal of this state is output to detecting section 27 and the function of the equipment is switched. In this state, as switch 23 is not engaging protruding portion 13B, switch 23 does not output an electric signal to detecting section 27.

Figure 4C:
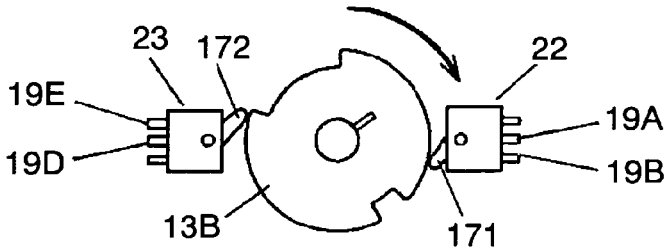

Next, knob 12A is further rotated clockwise by 30° as shown in FIG. 4C. With this operation, operating member 12 is rotated, protruding portion 13B pushes lever 172, lever 172 swings upward from the neutral position and terminals 19D, 19E of switch 23 also become mutually conducting. As a result, both terminals 19A, 19B of switch 22 and terminals 19D, 19E of switch 23 output electric signals to detecting section 27.

Figure 4D:
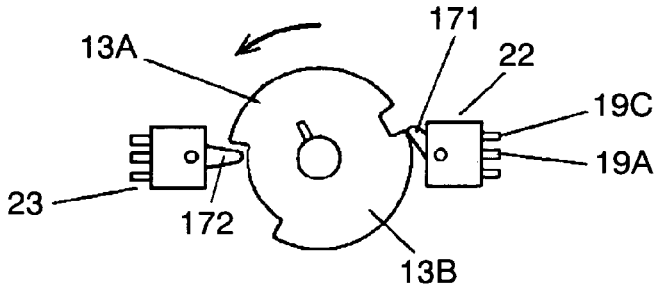

FIG. 4D shows a state in which knob 12A is rotated counterclockwise by 30° from the position shown in FIG. 4A. In this state, protruding portion 13B pushes lever 171, lever 171 swings upward from the neutral position and terminals 19A, 19B of switch 22 become mutually conducting. As a result, switch 22 outputs an electric signal to detecting section 27 and the function of the equipment is switched. Here, in this state, as switch 23 is not engaging protruding portion 13A, switch 23 does not output an electric signal to detecting section 27.

Figure 4E:
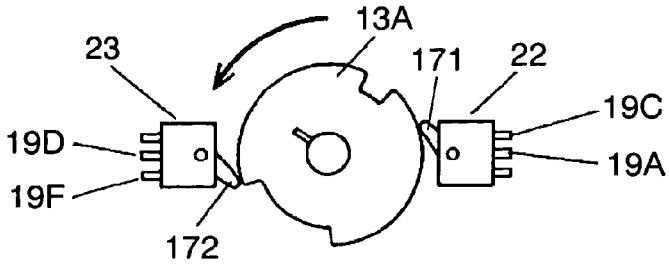

FIG. 4E shows a state in which operating member 12 is further rotated counterclockwise by 30° from this state. In this state, protruding portion 13A pushes lever 172, lever 172 swings downward from the neutral position and terminals 19D, 19F also become mutually conducting. As a result, terminals 19A, 19C of switch 22 and terminals 19D, 19F of switch 23 output electric signals to detecting section 27.

In summary, operating member 12 has cam section 12C that includes a plurality of protruding portions 13A, 13B. And, depending on the direction of swinging of lever 171, switch 22 outputs an electric signal from either terminals 19A, 19B or terminals 19A, 19C. Similarly, depending on the direction of swinging of lever 172, switch 23 outputs an electric signal from either terminals 19D, 19E or terminals 19D, 19F. By employing this configuration, a plurality of electric ON/OFF states can be obtained.

Accordingly, in this configuration, five operating positions can be detected by using two switches 22, 23 as shown in FIG. 4A to FIG. 4E.

In this configuration, as described above, operating member 12 has protruding portions 13A, 13B, and switches 22, 23 output signals of a plurality of electric ON/OFF states. With this, many positions of operation of operating member 12 can be detected with a small number of switches. Accordingly, a switch device with which an operating member can be set at various positions of rotation is provided at a low cost.

In the above description, switches 22, 23 are disposed on the right and left of operating member 12 at an angle of 180° from each other relative to the axis of rotation of operating member 12. And a description is given of a configuration in which operating member 12 is rotated to four positions in increments of 30°. In addition to this, a switch device may also be configured by changing the location of switches, the location and angle of providing protruding portions 13A, 13B, or further disposing many switches in order that various positions of rotation of operating member 12 can be detected.

Figure 5:
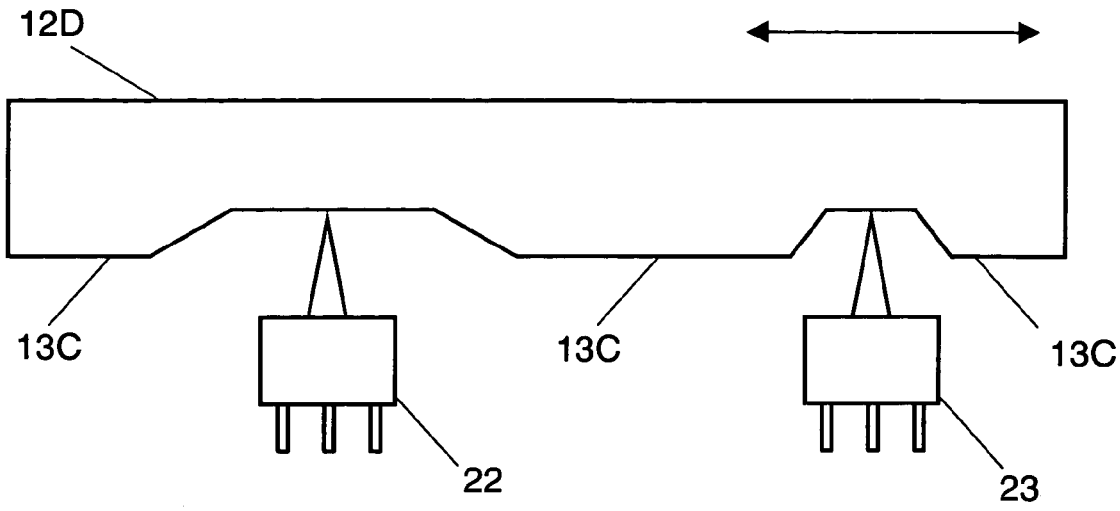
FIG. 5 is a fragmentary plan view of still another switch device in the exemplary embodiment of the present invention.

Also, a description is given only of a configuration in which operating member 12 is rotated. In addition to this, a switch device may also be configured with operating member 12D provided with a plurality of protruding portions 13C as shown in FIG. 5 and movable in a straight line and switches 22, 23 that engage protruding portion 13C to thereby detect various positions of operation of operating member 12D.

Figure 6:
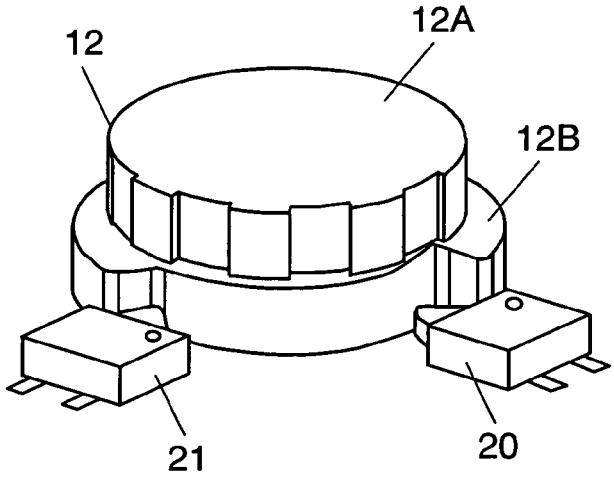
FIG. 6 is a fragmentary perspective view of still another switch device in the exemplary embodiment of the present invention.
Figure 7:
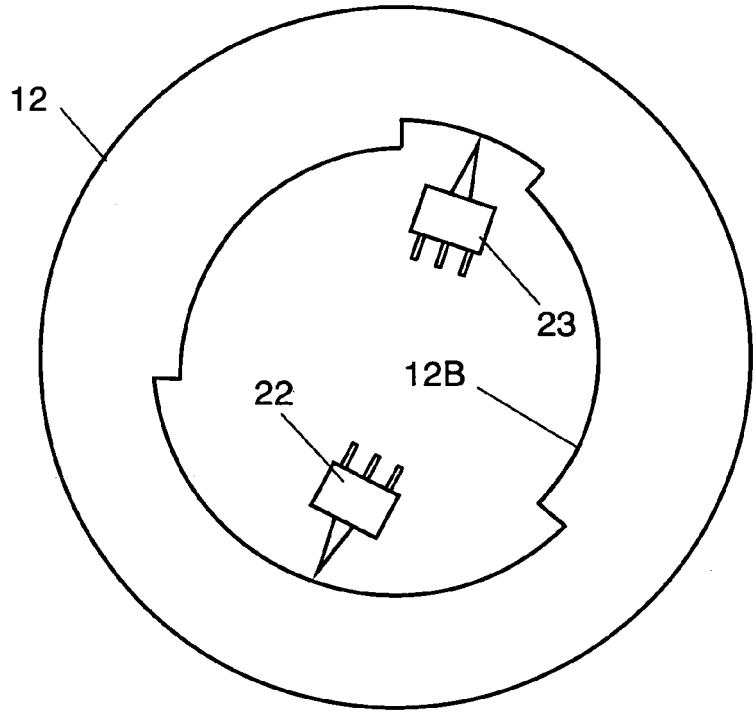
FIG. 7 is a fragmentary plan view of still another switch device in the exemplary embodiment of the present invention.
Figure 8:
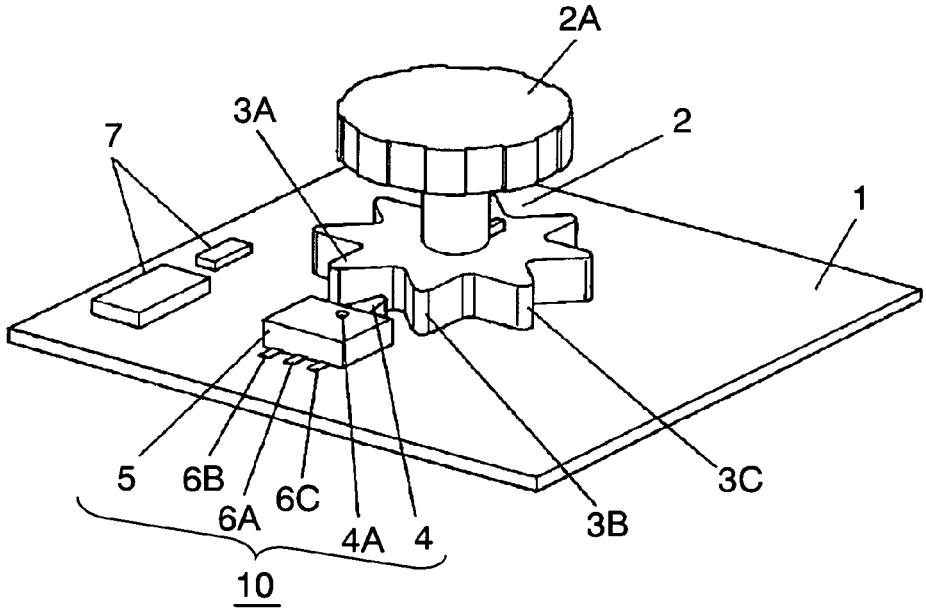
FIG. 8 PRIOR ART
FIG. 8 is a perspective view of a conventional switch device.
Figure 9A:
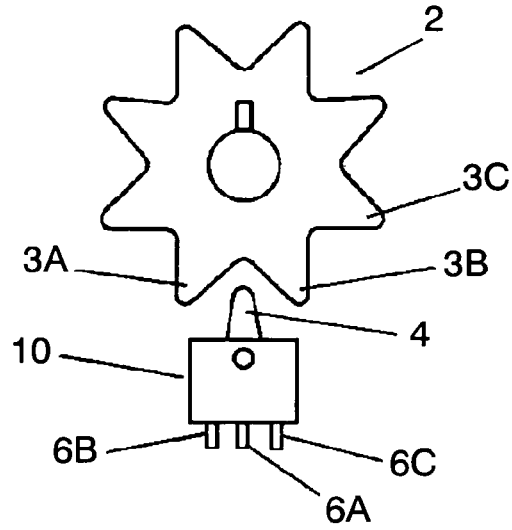
FIG. 9A PRIOR ART
FIG. 9A to FIG. 9C are fragmentary plan views of the switch device of FIG. 8.
Figure 9B:
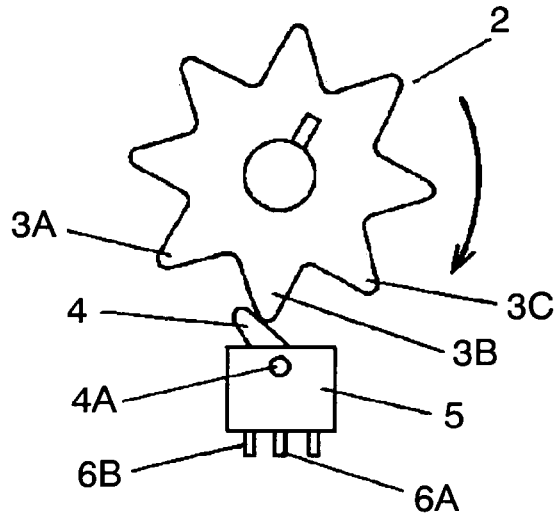
FIG. 9B PRIOR ART
Figure 9C:
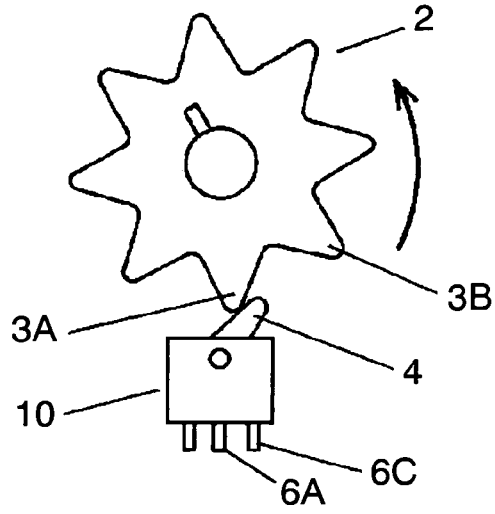
FIG. 9C PRIOR ART

Also, a description is given of a configuration in which a cam section having protruding portions 13, 13A, 13B are formed on the lower outer periphery of operating member 12. In addition to this, depending on the mode of operation or shape of operating member 12, cam sections 12B may be formed at different locations of knob 12A such as on the lower part or on the inner surface as illustrated in FIG. 6 and FIG. 7.

As described above, a switch device is obtainable that is simple in structure and that can reliably detect positions of operation of the operating member according to the present invention.

What is claimed is:

1. A switch device comprising:

an operating member having a cam member provided with a protruding portion;

a plurality of switches that engage the cam member and output electric ON/OFF states based on the operation of the operating member; and a detecting section connected to the plurality of switches for detecting a position of operation of the operating member based on the electric ON/OFF states of the plurality of switches.

2. The switch device of claim 1, wherein the operating member and the cam member are rotatable about a rotary axis and the detecting section detects a rotary position of operation of the operating member about the rotary axis.

3. The switch device of claim 1, wherein the operating member and the cam member are slidable and the detecting section detects a slide position of operation of the operating member.

4. The switch device of claim 1, wherein the protruding portion is one of a plurality of protruding portions, the cam member has the plurality of protruding portions, and the plurality of switches output a plurality of electric ON/OFF states.

5. The switch device of claim 1, wherein the operating member further includes a knob for operating the cam section and a coupling member for coupling the knob and the cam member.

6. The switch device of claim 1, wherein the operating member further includes a knob having the cam member on a lower surface for operating the cam member.

7. The switch device of claim 1, wherein the operating member further includes a knob having the cam member on an inner surface for operating the cam member.

8. The switch device of claim 1, wherein said operating member is rotatable about a rotary axis, and said switches are respectively disposed at different circumferential positions about the rotary axis.

9. A switch device comprising:

an operating member having a user-operable member and a cam section fixed for rotation with said user-operable member about a rotary axis, said cam section being provided with a protruding portion;

a plurality of switches that engage the cam section and output electric ON/OFF states based on the operation of the operating member; and a detecting section connected to the plurality of switches for detecting a rotary position of operation of the operating member about said rotary axis based on the electric ON/OFF states of the plurality of switches.

10. The switch device of claim 9, wherein the protruding portion is one of a plurality of protruding portions, the cam section has the plurality of protruding portions, and the plurality of switches output a plurality of electric ON/OFF states.

11. The switch device of claim 9, wherein the user-operable member is a knob for operating the cam section; and the operating member further includes a coupling section for coupling the knob and the cam section.

12. The switch device of claim 9, wherein the user-operable member is a knob having the cam section on a lower surface for operating the cam section.

13. The switch device of claim 9, wherein the user-operable member is a knob having the cam section on an inner surface for operating the cam section.

14. The switch device of claim 9, wherein said switches are respectively disposed at different circumferential positions about the rotary axis.

* * * * *